US011085657B2

(12) United States Patent
Chen

(10) Patent No.: US 11,085,657 B2
(45) Date of Patent: Aug. 10, 2021

(54) HUMIDIFIER AND FLOAT BLOCK FOR HUMIDIFIER

(71) Applicant: Ganlin Chen, Guangdong (CN)

(72) Inventor: Ganlin Chen, Guangdong (CN)

( * ) Notice: Subject to any disclaimer, the term of this patent is extended or adjusted under 35 U.S.C. 154(b) by 304 days.

(21) Appl. No.: 16/013,959

(22) Filed: Jun. 21, 2018

(65) Prior Publication Data

US 2019/0063768 A1 Feb. 28, 2019

(30) Foreign Application Priority Data

Aug. 23, 2017 (CN) ..... 201710727510.2

(51) Int. Cl.
*F24F 6/12* (2006.01)
*F24F 11/88* (2018.01)
*F24F 6/00* (2006.01)

(52) U.S. Cl.
CPC ..... *F24F 6/12* (2013.01); *F24F 11/88* (2018.01); *F24F 2006/008* (2013.01)

(58) Field of Classification Search
CPC ..... F24F 6/12; F24F 2006/008; F24F 11/88; F24F 13/28; Y02B 30/80
See application file for complete search history.

(56) References Cited

U.S. PATENT DOCUMENTS

2012/0222548 A1* 9/2012 Lev ..... F24F 6/12 95/1
2014/0326802 A1* 11/2014 Ljuhar ..... B05B 17/0615 239/102.2
2016/0146490 A1* 5/2016 McDonnell ..... F24F 6/12 261/70
2017/0082306 A1* 3/2017 Murakami ..... F24F 3/16
2017/0122597 A1* 5/2017 Choi ..... B01F 3/04085
2017/0122599 A1* 5/2017 Son ..... F24F 6/06
2018/0326445 A1* 11/2018 Wang ..... B05B 17/0615
2019/0024915 A1* 1/2019 Cai ..... F24F 6/12
2019/0041084 A1* 2/2019 Atkins, Jr. ..... F24F 6/00
2019/0049133 A1* 2/2019 Cai ..... F24F 11/30
2020/0096213 A1* 3/2020 Liang ..... F24F 6/12
2020/0103140 A1* 4/2020 Davis ..... F24F 13/28

FOREIGN PATENT DOCUMENTS

CN 206001642 * 3/2017

OTHER PUBLICATIONS

EPO translation of CN206001642 (Year: 2017).*

* cited by examiner

*Primary Examiner* — Stephen Hobson
(74) *Attorney, Agent, or Firm* — JCIPRNET

(57) ABSTRACT

A humidifier and a float block for the humidifier are provided. The humidifier includes a water tank and a base. The water tank is located on the base. An air channel is arranged inside the water tank. A lower end of the air channel communicates with a blower installed inside the base. A mist passage chamber is vertically in the water tank. An upper end of the air channel communicates with an upper end of the mist passage chamber via a mist guide tube. The float block is arranged to float up and down inside the mist passage chamber. An atomizer corresponding to the mist passage chamber is installed at a lower end of the water tank.

13 Claims, 4 Drawing Sheets

HUMIDIFIER AND FLOAT BLOCK FOR HUMIDIFIER

CROSS-REFERENCE TO RELATED APPLICATION

This application claims the priority benefit of China application serial no. 201710727510.2, filed on Aug. 23, 2017. The entirety of the above-mentioned patent application is hereby incorporated by reference herein and made a part of this specification.

BACKGROUND

Technical Field

The disclosure relates to the field of humidifiers, and in particular, to a humidifier and a float block for the humidifier.

Description of Related Art

The humidifier is a small appliance commonly used in daily life. The humidifiers currently available generally do not exhibit a high efficiency in atomization of liquids, and the generated mist amount is often not large, which limits the effect of utilization of the humidifiers. To add water into the humidifiers currently available, the water tank must be picked up upside down, making the addition of water very inconvenient and also difficult to clean and easy to breed bacteria. In addition, in the humidifier currently available, the distance between the water surface of the water contained in the water tank and the atomizer at the bottom of the water tank cannot exceed a specific value. Otherwise, the mist amount generated will be very small due to the high water level in the humidifier currently available. As a result, the user must often add water because of the small amount of water that can be accommodated in the humidifier currently available.

SUMMARY

The disclosure provides a humidifier and a float block for the humidifier that generate a larger mist amount and enhance the effect of utilization.

A humidifier of an embodiment of the disclosure includes a water tank and a base. The water tank is located on the base. An air channel is arranged inside the water tank. A lower end of the air channel communicates with a blower installed inside the base. A mist passage chamber is arranged in the water tank. An upper end of the air channel communicates with an upper end of the mist passage chamber via a mist guide tube. A float block is arranged to float up and down inside the mist passage chamber. An atomizer corresponding to the mist passage chamber is installed at a lower end of the water tank.

A float block of an embodiment of the disclosure is used in a humidifier. The float block includes an outer barrel that is hollow inside, and an inner float block is arranged to float inside the outer barrel.

In the humidifier and the float block for the humidifier of the embodiments of the disclosure, by applying a pressure to the liquid through the float block, a larger mist amount is generated and the effect of utilization is enhanced.

DESCRIPTION OF THE EMBODIMENTS

The disclosure is further illustrated with reference to specific embodiments below. It is understood that the embodiments are merely meant to illustrate the disclosure rather than limit the scope of the disclosure. Moreover, it is also understood that, after reviewing the content taught in the disclosure, people skilled in the art may make various variations or modifications to the disclosure, and these equivalent forms similarly fall within the scope defined by the claims attached to the specification.

Figure 1A:
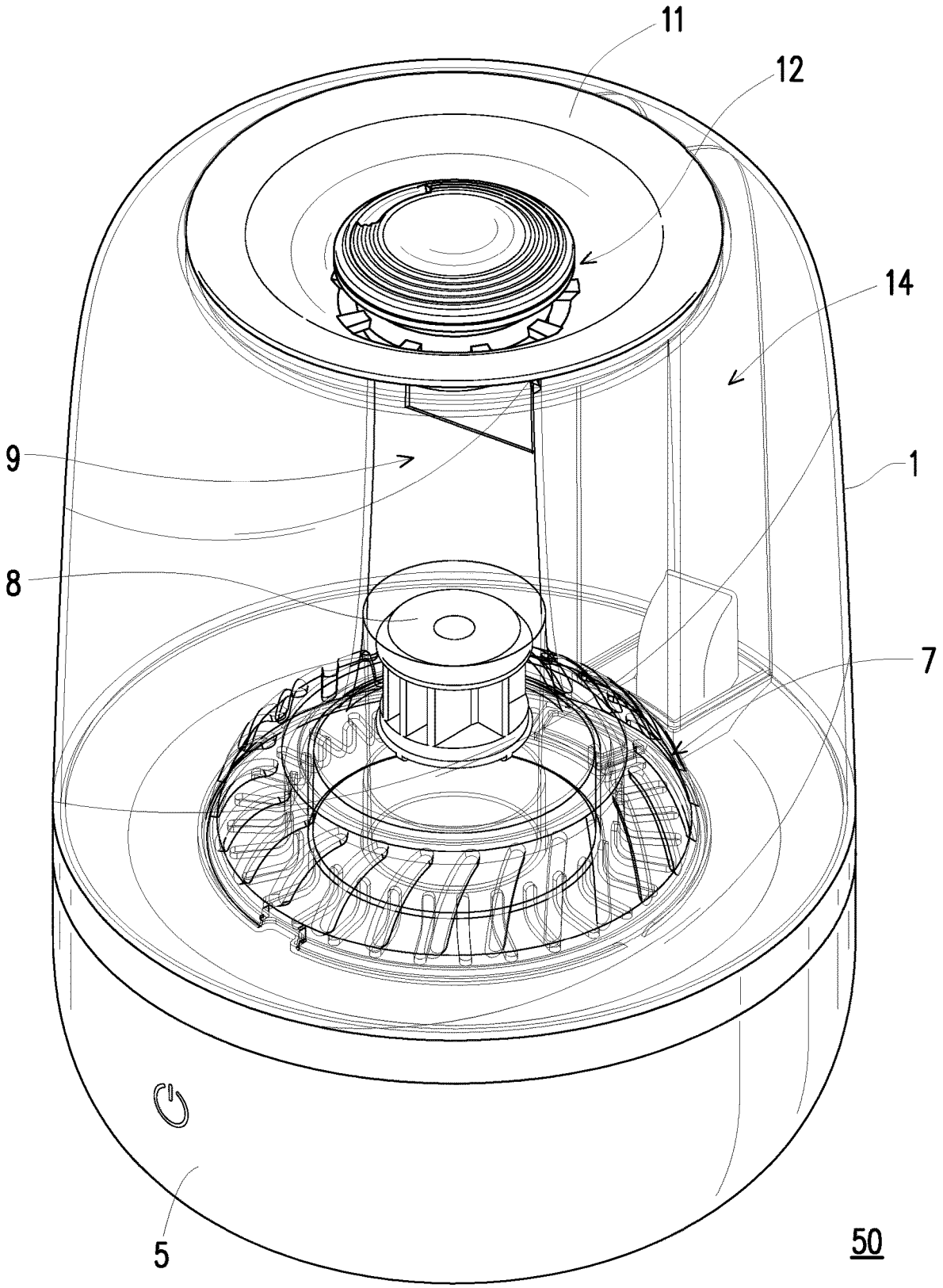
FIG. 1A is a perspective diagram illustrating a humidifier of the disclosure.
Figure 1B:
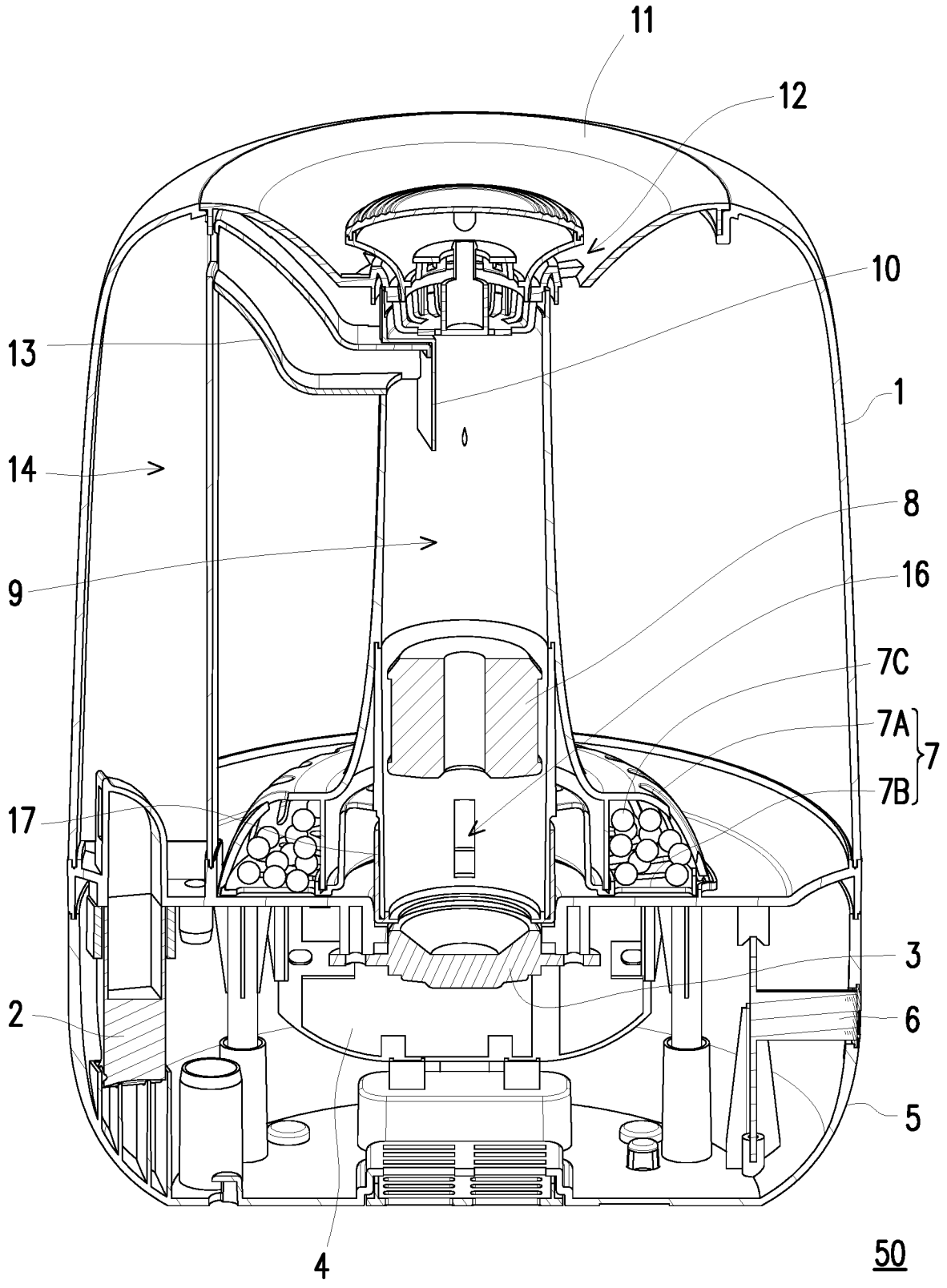
FIG. 1B is a perspective cross-sectional view illustrating a humidifier of the disclosure.

As shown in FIG. 1A and FIG. 1B, an embodiment of the disclosure relates to a top-fill humidifier 50 including a mist guide purification device. The humidifier 50 includes a water tank 1 and a base 5. The water tank 1 is located on the base 5. An air channel 14 is arranged inside the water tank 1. A lower end of the air channel 14 communicates with a blower 2 installed inside the base 5. Therefore, an air flow generated by the blower 2 can be conveyed to a top portion of the water tank 1 along the air channel 14. A mist passage chamber 9 is arranged in the water tank 1. An upper end of the air channel 14 communicates with an upper end of the mist passage chamber 9 via a mist guide tube 13 on a side. An atomizer 3 corresponding to the mist passage chamber 9 is installed at a lower end of the water tank 1. A float block 8 having an opening in a middle portion is arranged to float up and down inside the mist passage chamber 9. In other words, the float block 8 can move up and down inside the mist passage chamber 9 and is not fixed at a specific height inside the mist passage chamber 9.

When in use, water or another liquid to be atomized is added into the water tank 1. Then, the atomizer 3 starts to function and atomizes the liquid to be atomized in the mist passage chamber 9. Mist moves upward along the mist passage chamber 9 to the top portion of the water tank 1 and then is discharged. Meanwhile, the blower 2 also starts to function, and the generated air flow is blown upward along the air channel 14 and enters the upper end of the mist passage chamber 9 via the mist guide tube 13, which simultaneously drives blow of the mist to the outside and enhances the efficiency of mist discharge. Moreover, a pressure is applied to the liquid to be atomized through the float block 8 located in the mist passage chamber 9, which enhances the efficiency of atomization of the liquid to be atomized by the atomizer 3. In an actual operation, it was found that a mist amount generated by using the float block 8 was significantly increased as compared to a mist amount generated without using the float block 8.

Optionally, a density of the float block 8 of the present embodiment may be smaller than the density of water. Therefore, the float block 8 can stay on the surface of the liquid to be atomized. In an actual operation, it was found that when the float block 8 stayed on the surface of the liquid to be atomized, the atomization efficiency of the atomizer 3 was further significantly enhanced.

In the present embodiment, a switch module 6 and a control circuit board 4 are installed on a sidewall on a side of the base 5. The switch module 6 is configured to turn on/off the humidifier 50, and the control circuit board 4 is configured to control operation statuses of the atomizer 3, the blower 2, and other components. Moreover, a float block positioning sleeve 17 is sleeved at the lower end of the mist passage chamber 9 to avoid direct contact between the float block 8 and the atomizer 3. The air channel 14 can be vertically arranged on a side inside the water tank 1, and the mist passage chamber 9 can be vertically arranged in a middle portion of the water tank 1.

In the present embodiment, a filter part 7 having hollowed sidewalls is arranged to be outer to the lower end of the mist passage chamber 9. A filter material 7C is filled in the filter part 7. For clarity of the drawings, the filter material 7C is only shown in FIG. 1B. The filter part 7 includes, for example, a filter cover 7A and a filter inner cover 7B. The filter inner cover 7B located on a bottom surface of the water tank 1 is arranged to be inner to a lower end of the filter cover 7A. A filter inner chamber having hollowed sidewalls is formed between the filter inner cover 7B and the filter cover 7A, and the filter inner chamber is filled with the filter material 7C. Such structure exhibits excellent filtering effect.

In the present embodiment, an upper lid 11 is installed at the upper end of the water tank 1. A spray nozzle 12 located at the upper end of the mist passage chamber 9 is installed in a middle portion of the upper lid 11. The mist can be blown to the outside via the spray nozzle 12. The upper lid 11 can adequately block foreign matters such as dust in the environment from entering the water tank and prevent pollution of the liquid to be atomized. A water feed hole 16 is configured in an axial direction on sidewalls on two sides at the lower end of the mist passage chamber 9 to allow water feeding. One end of the mist guide tube 13 is connected to a separation board 10 vertically located at the upper end of the mist passage chamber 9. The separation board 10 divides the upper end of the mist passage chamber 9 into two spaces and can prevent diffusion of the mist in the water tank 1, which effectively enhances a humidification amount of the product.

Figure 2:
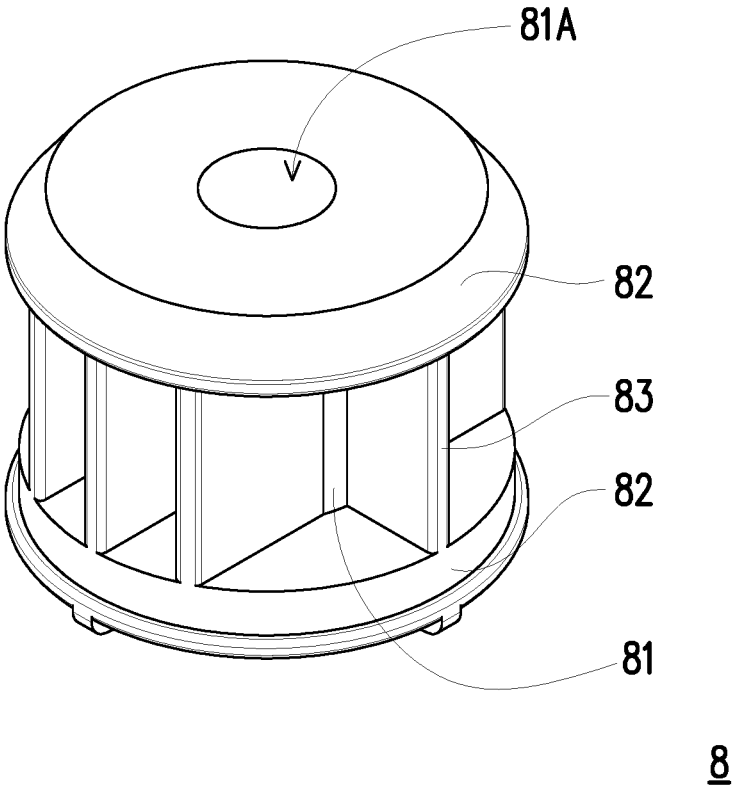
FIG. 2 is a perspective structural diagram illustrating a float block for a humidifier according to an embodiment of the disclosure.

As shown in FIG. 2, the float block 8 of the present embodiment includes a barrel 81 having an opening in a middle portion. Guide circular plates 82 matching an inner diameter of the mist passage chamber 9 of FIG. 1B are arranged at two ends in the axial direction of the barrel 81. A mist guide through-hole 81A is vertically arranged inside the barrel 81 such that the mist can move toward the upper end of the mist passage chamber 9 via the mist guide through-hole 81A. With the guide circular plates 82, the float block 8 can smoothly move in the mist passage chamber 9 without rotating easily. Multiple axial direction reinforcement plates 83 are arranged surrounding a circumference outside the barrel 81, which contributes to structural reliability.

According to an embodiment of the disclosure, when in use, the upper lid 11 is opened, water or another liquid to be atomized is added into the water tank 1, and the liquid to be atomized passes through the filter cover 7A and the filter inner cover 7B and then enters the mist passage chamber 9 via the water feed hole 16. The liquid to be atomized pushes the float block 8 up such that the float block 8 floats on the water surface. Then, the atomizer 3 starts to function and atomizes the liquid to be atomized in the mist passage chamber 9. The mist moves upward from the mist guide through-hole 81A of the float block 8 and is discharged via the spray nozzle 12. Meanwhile, the blower 2 also starts to function, and the generated air flow is blown upward along the air channel 14 and enters the upper end of the mist passage chamber 9 via the mist guide tube 13, which simultaneously drives blow of the mist to the outside and enhances the efficiency of mist discharge. A pressure is applied to the surface of the liquid to be atomized through the float block 8 located in the mist passage chamber 9, which enhances the efficiency of atomization of the liquid to be atomized by the atomizer 3.

Figure 3:
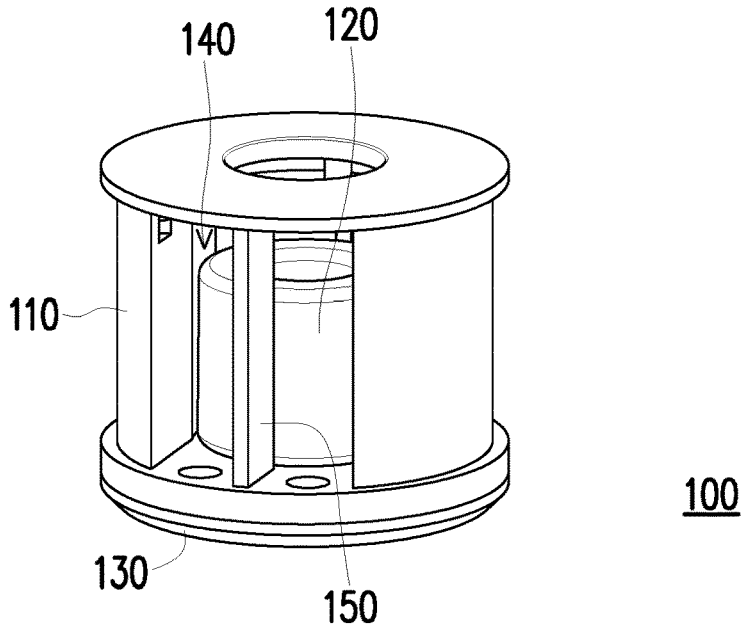
FIG. 3 is a perspective structural diagram illustrating a float block for a humidifier according to another embodiment of the disclosure.
Figure 4:
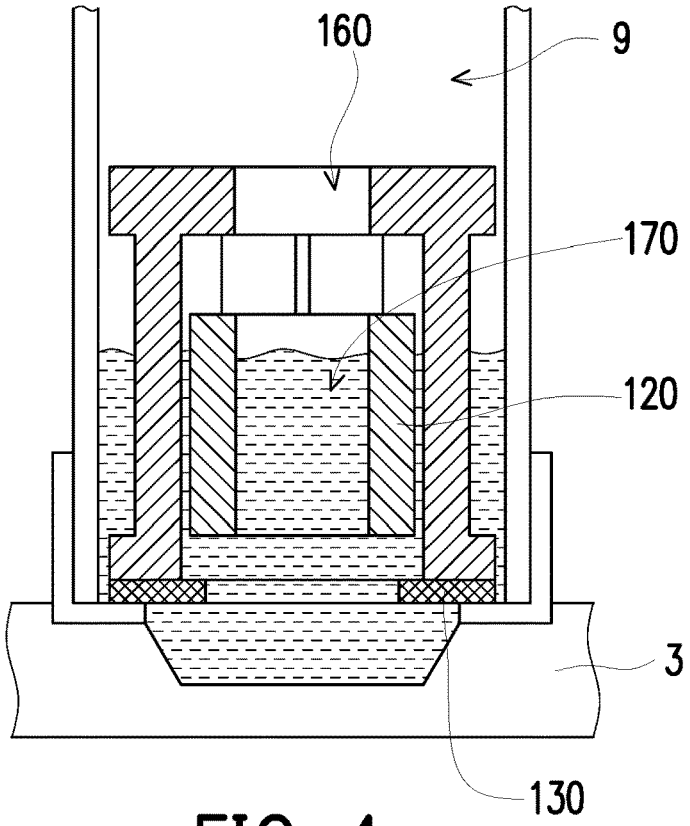
FIG. 4 is a cross-sectional diagram illustrating a use status of the float block of FIG. 3 installed in the humidifier.

As shown in FIG. 3 and FIG. 4, a float block 100 of another embodiment of the disclosure includes an outer barrel 110 that is hollow inside. An inner float block 120 is arranged to float up and down inside the outer barrel 110. When the surface of the liquid to be atomized in the mist passage chamber 9 is low, the outer barrel 110 of the float block 100 may contact the float block positioning sleeve 17 or the atomizer 3 below, such that the outer barrel 110 cannot apply a pressure to the liquid to be atomized. However, since the outer barrel 110 further includes the inner float block 120 inside, even if the surface of the liquid to be atomized is low, the inner float block 120 can still stay on the surface of the liquid to be atomized and continue to apply a pressure to the liquid to be atomized without contacting the float block positioning sleeve 17 or the atomizer 3 below. Accordingly, the float block 100 of the present embodiment can still increase the mist amount generated by the humidifier even if the surface of the liquid to be atomized is low.

In the present embodiment, an opening is configured at a lower end of the outer barrel 110. A mist guide through-hole 170 is vertically arranged inside the inner float block 120. An upper mist guide hole 160 is arranged in the middle of a top portion at an upper end of the outer barrel 110. The mist guide through-hole 170 and the upper mist guide hole 160 are both configured to allow the mist to pass. A hollowed part 140 is configured on sidewalls on two sides of the outer barrel 110. A seal ring 130 is installed at the lower end of the outer barrel 110. The seal ring 130 seals the inner float block 120 inside the outer barrel 110. A connection plate 150 is vertically arranged in a middle portion of the hollowed part 140 to enhance an overall structural strength.

In the humidifier and the float block for the humidifier of the disclosure, by disposing the float block to apply a pressure to the liquid, a larger mist amount is generated and the effect of utilization is enhanced. When the filter part is disposed, the humidifier further exhibits purification and filtering functions, enhances purity of the mist, and is more hygienic. When the inner float block is disposed in the float block, the mist amount generated by the humidifier can still be increased even if the surface of the liquid to be atomized is low.

What is claimed is:

1. A humidifier comprising a water tank and a base, wherein the water tank is located on the base, an air channel is arranged inside the water tank, a lower end of the air channel communicates with a blower installed inside the base, a mist passage chamber is arranged in the water tank, an upper end of the air channel communicates with an upper end of the mist passage chamber via a mist guide tube, a float block is arranged to float up and down inside the mist passage chamber, and an atomizer corresponding to the mist passage chamber is installed at a lower end of the water tank, wherein the float block comprises an outer barrel that is hollow inside, and an inner float block is arranged to float up and down inside the outer barrel.

2. The humidifier according to claim 1, wherein a filter part having hollowed sidewalls is arranged to be outer to a lower end of the mist passage chamber, and a filter material is filled in the filter part.

3. The humidifier according to claim 1, wherein the float block comprises a barrel having an opening in a middle portion, guide circular plates matching an inner diameter of the mist passage chamber are arranged at two ends in an axial direction of the barrel, and multiple axial direction reinforcement plates are arranged surrounding a circumference of the barrel.

4. The humidifier according to claim 1, wherein an upper lid is installed at an upper end of the water tank, and a spray nozzle located at the upper end of the mist passage chamber is disposed in a middle portion of the upper lid.

5. The humidifier according to claim 1, wherein a water feed hole is configured in an axial direction on sidewalls at a lower end of the mist passage chamber.

6. The humidifier according to claim 1, wherein one end of the mist guide tube is connected to a separation board vertically located at the upper end of the mist passage chamber.

7. The humidifier according to claim 1, wherein the air channel is vertically arranged on a side inside the water tank, and the mist passage chamber is vertically arranged in a middle portion of the water tank.

8. The humidifier according to claim 1, wherein a float block positioning sleeve is sleeved at a lower end of the mist passage chamber.

9. The humidifier according to claim 1, wherein an opening is configured at a lower end of the outer barrel, an upper mist guide hole is arranged in the middle of a top portion at an upper end of the outer barrel, a hollowed part is configured on sidewalls on two sides of the outer barrel, a seal ring is installed at the lower end of the outer barrel, and the seal ring seals the inner float block inside the outer barrel.

10. The humidifier according to claim 9, wherein a connection plate is vertically arranged in a middle portion of the hollowed part.

11. The humidifier according to claim 1, wherein a mist guide through-hole is vertically arranged inside the inner float block.

12. The humidifier according to claim 1, wherein a density of the outer barrel and a density of the inner float block are smaller than a density of water.

13. The humidifier according to claim 1, wherein a density of the float block is smaller than a density of water.

* * * * *